US005215494A

United States Patent [19]

Flanagan

[11] Patent Number: 5,215,494

[45] Date of Patent: Jun. 1, 1993

[54] BREAST FOUNDATION AND NATURAL SUPPORT

[76] Inventor: Patricia C. Flanagan, 37 Woodcock Ave. #21, Haverhill, Mass. 01832

[21] Appl. No.: 871,017

[22] Filed: Apr. 20, 1992

[51] Int. Cl.[5] ..... A41C 3/00

[52] U.S. Cl. ..... 450/61; 450/41; 450/51; 450/53; 450/65; 2/73

[58] Field of Search ..... 2/67, 73, 104, 105; 450/31, 34, 41, 45, 47, 49, 51, 52, 53, 54, 55, 56, 57, 60, 61, 65, 66, 67, 74, 75, 76

[56] References Cited

U.S. PATENT DOCUMENTS

| | | | |
|---|---|---|---|
| 1,890,507 | 12/1932 | Gifford | 2/67 X |
| 1,994,359 | 3/1935 | Greenbaum | 450/76 |
| 2,624,049 | 1/1953 | Granne | 2/73 X |
| 2,661,470 | 12/1953 | Day | 450/54 X |
| 2,761,147 | 9/1956 | Gluckin | 450/52 |
| 2,764,761 | 10/1956 | Rosenthal et al. | 450/52 |
| 2,794,984 | 6/1957 | Astor | 450/52 |
| 2,884,928 | 5/1959 | Baer | 450/55 X |
| 2,967,527 | 1/1961 | Maas | 450/52 X |
| 2,973,764 | 3/1961 | Steiner | 450/52 |
| 2,988,086 | 6/1961 | Rydin | 450/56 |
| 3,396,729 | 8/1968 | Glick | 450/52 X |
| 3,419,895 | 12/1968 | Stephensen | 450/74 X |
| 3,491,762 | 1/1970 | Simonsen | 450/60 |
| 3,704,713 | 12/1972 | Hopper | 450/52 |
| 3,779,250 | 12/1973 | Radomski | 450/65 |
| 3,964,491 | 6/1976 | Martini | 450/52 |
| 4,699,144 | 10/1987 | Sherwood | 450/54 |
| 4,875,236 | 10/1989 | Boynton | 2/67 |
| 5,037,348 | 8/1991 | Farino | 2/73 X |
| 5,045,019 | 9/1991 | Capasso et al. | 450/65 X |
| 5,116,278 | 5/1992 | Sroub et al. | 2/67 X |

FOREIGN PATENT DOCUMENTS

| | | | |
|---|---|---|---|
| 0559352 | 4/1960 | Belgium | 450/56 |
| 0479639 | 12/1951 | Canada | 450/61 |
| 0894082 | 10/1953 | Fed. Rep. of Germany | 450/60 |
| 0091862 | 4/1938 | Sweden | 450/61 |
| 0365258 | 1/1932 | United Kingdom | 450/61 |
| 1187315 | 4/1970 | United Kingdom | 450/52 |

*Primary Examiner*—Clifford D. Crowder
*Assistant Examiner*—Jeanette E. Chapman
*Attorney, Agent, or Firm*—Abelman Frayne & Schwab

[57] ABSTRACT

A breast foundation and natural support characterized by its immobility relative to the rib-cage and also by its capacity to permit independent movement of breasts while comfortably supporting same. The support assembly includes inner and outer front panels, the later having seam connection to at least the principal supporting cup and the former bearing an underwire. In a modification for the fuller breast, a double cup is interconnected to the outer front panel. An optional prosthesis pocket is also available, wherein a separate piece of fabric is connected at the top of the foundation in both forms of the invention, the fabric hangs down to form a pocket from above. As the prosthesis in inserted from an open side and held in place by the lower pocket, an upper pocket is thus formed.

5 Claims, 4 Drawing Sheets

FIG. 1
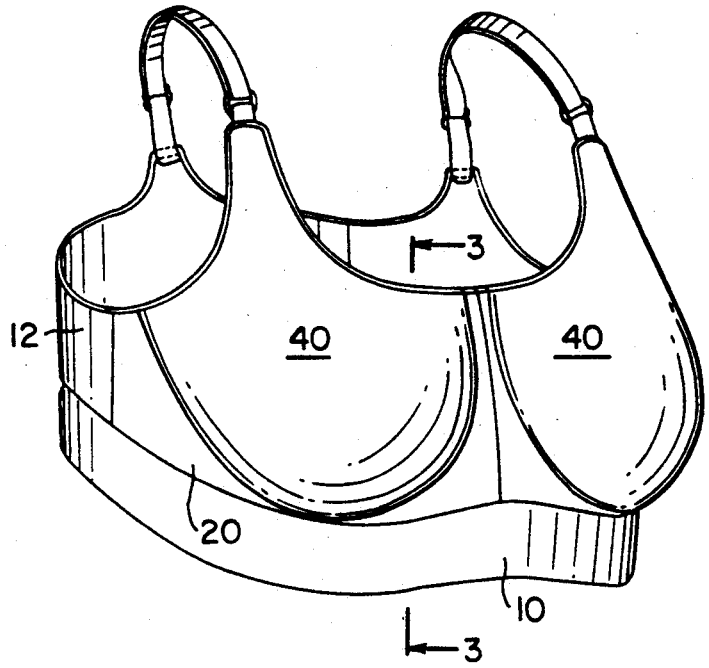
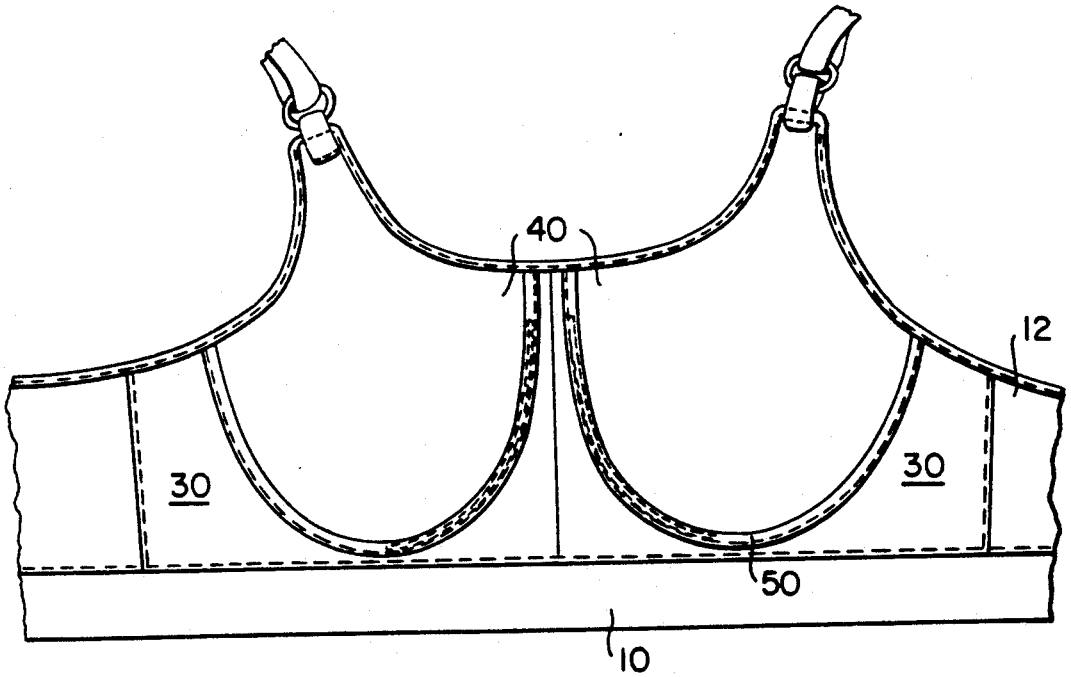
FIG. 2

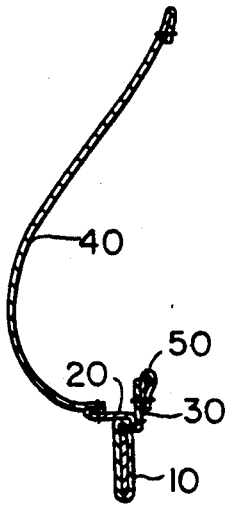
FIG. 3
FIG. 6A
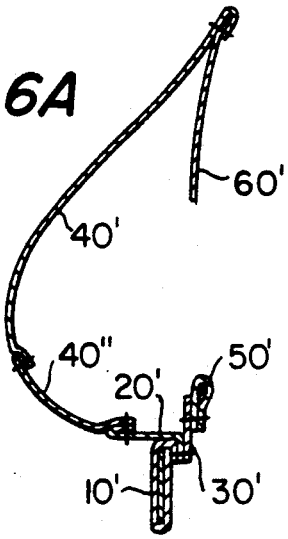
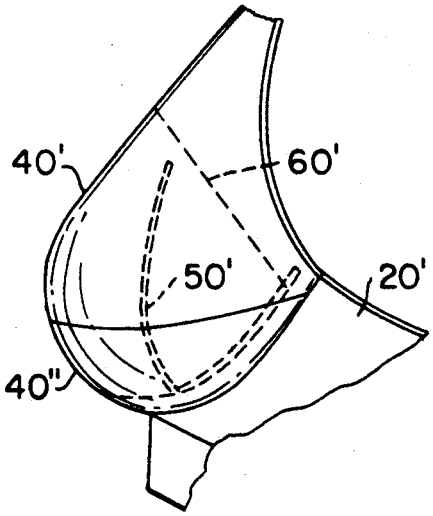
FIG. 6B

FIG. 4
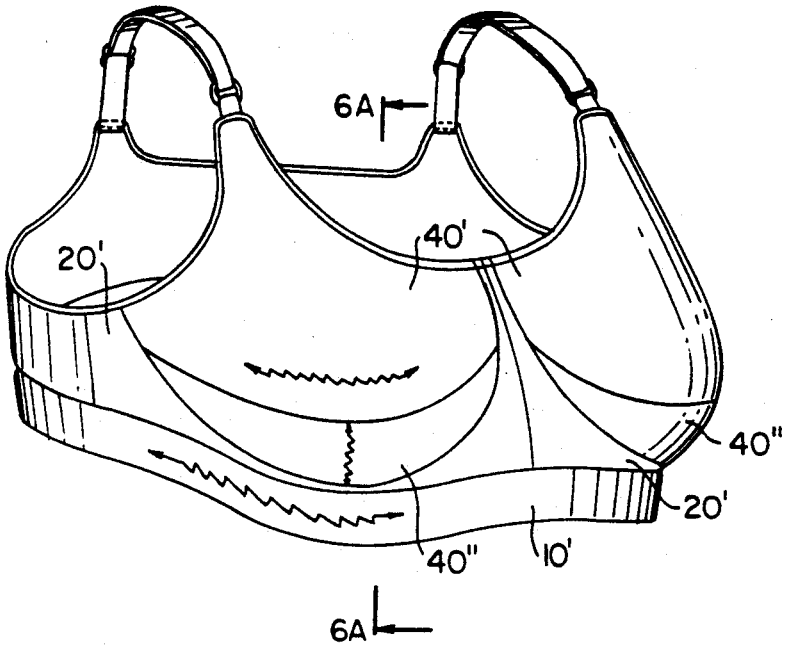
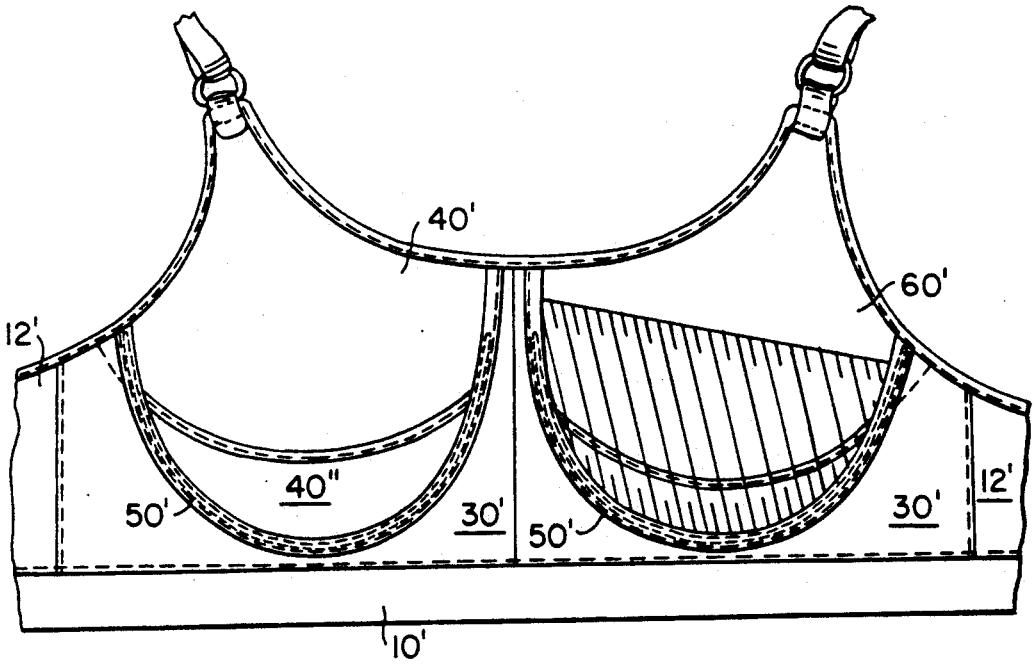
FIG. 5

FIG. 7
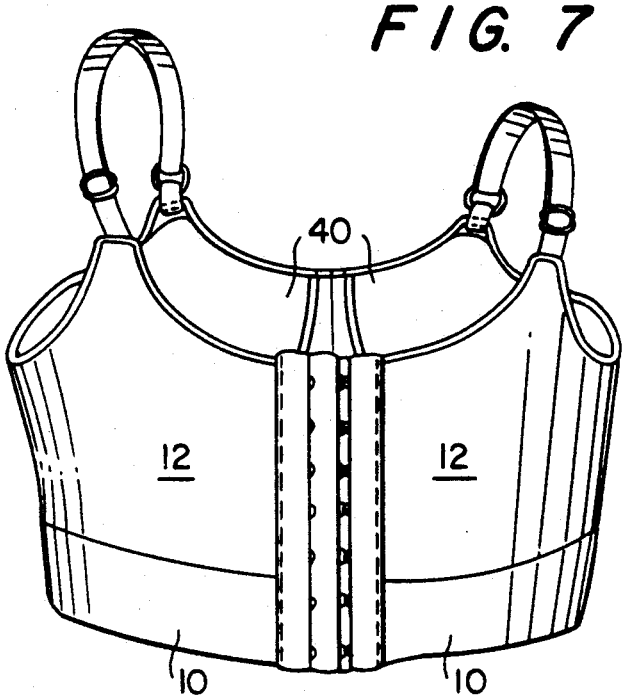
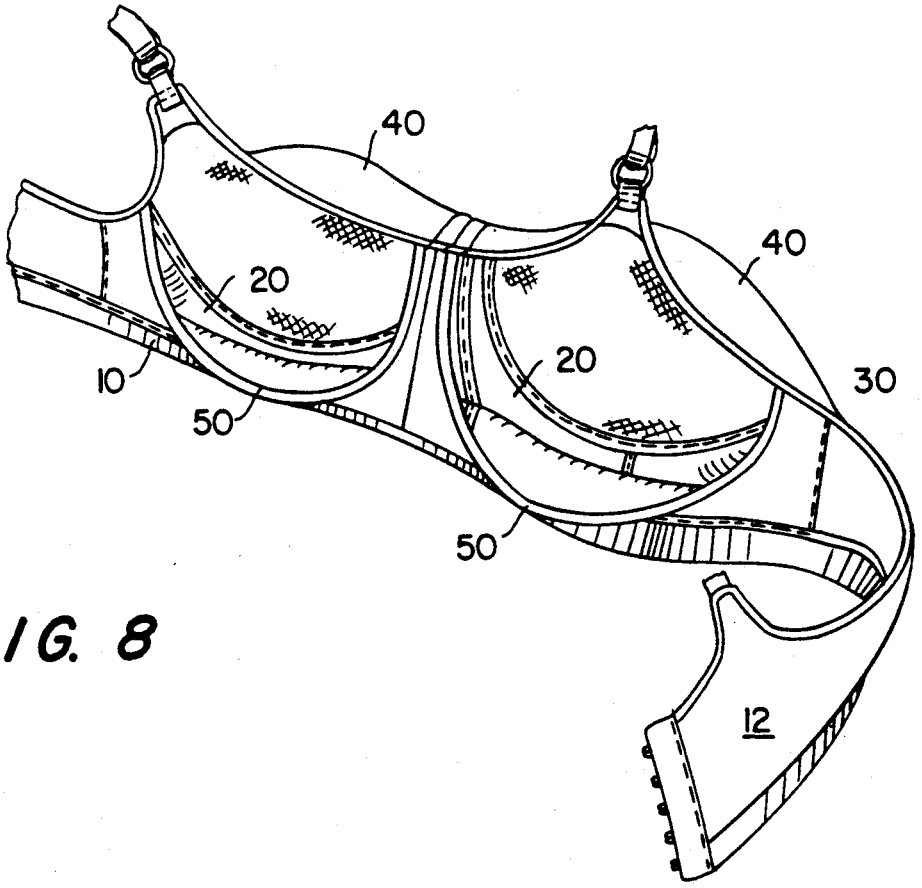
FIG. 8

BREAST FOUNDATION AND NATURAL SUPPORT

BACKGROUND OF THE INVENTION

Traditionally, female brassieres are designed and adapted to fit on models having ideal figures which are relatively small in cup and rib-cage size. Once the fit has been perfected on these models, the patterns are upgraded in size and the bra product is made, but the traditional bra cup is not shaped to conform to the human female breast. In the traditional bra, the supporting fabric of the bra angles upwardly and outwardly from an underwire attachment point, leaving very little fabric to accomodate a full breast, which has most of its weight below the apex of the breast. It is well known that the distribution of weight of the breast rests primarily below the apex, the fullest or forwardmost point of the bust. As indicated, most conventional bras are provided with and designed to force symmetrical distribution of the breast mass. As the breast of the user develops larger and or heavier, the problem of trying to fit into traditional bra designs is magnified. During wear, the weight of the breast pulls on the shoulder straps of traditional bras, essentially because their function is to lift the bust up to be symmetrical. Accordingly, the breast tends to slide out the bottom of the bra, because it cannot stay in this unnatural position, leaving the underwire to rest on the outside of the breast where it leaves the chest rather than resting up and under the breast where it attaches to the chest cavity where it may provide support. Thus, as a given breast mass is lifted from its natural hang; there not being provided ample fabric to accommodate the mass at its fullest point, much discomfort and frustration develop for women users attempting to find a functional foundation garment that fits.

The present invention provides natural support of breasts to accommodate not only the average but also the very full cup and larger size woman. In addition, it is not only intended exclusively for use during exercise, but it may also serve as a day-to-day foundation garment having optional provision for utility as a prosthesis support. In its generic form it is a unitary bra wherein the breast supports each comprise either a single or a double cup assembly

THE PRIOR ART

There follows a listing of the known patented art as it relates to the breast foundation garment of this invention: G.V. Wood, 1,176,393, 03/09/26; E. Fredrico, 2,092,390, 09/07/37; W. Rosenthal, 2,763,010, 09/18/56. In none of the afore-cited patents is the combination of applicant's breast foundation and natural support shown, reference the following description, drawings and claims.

SUMMARY OF INVENTION

A breast foundation garment useful as a bra which conforms to the natural shape of the breast without reshaping or redistributing the breast mass and which simultaneously supports same with comfort. In both forms of invention, certain secondary inner and outer front panels are provided to coactively insure independent support to the primary and supplemental supporting bra cups. Additionally, not only the underwire, but also the lowermost band are immobilized. In addition, the cup or cups are shaped with supplemental fabric below the breast apex, allowing the breast to shape the cup naturally.

THE DRAWINGS

FIG. 1 is a view in perspective of a species defined as a single-cup bra fabricated in accordance with the invention.

FIG. 2 is a partial rear view elevation, enlarged, of the bra in FIG. 1.

FIG. 3 is a vertical sectional view, enlarged, of the invention, taken along lines 3 —3 of FIG. 1.

FIG. 4 is a view in perspective of a species defined as a double-cup bra, in accordance with the invention.

FIG. 5 is an enlarged rear elevation, partial view of the invention depicted in FIG. 4, including prosthesis pocket.

FIG. 6A is a view in section, enlarged, of the FIG. 4 and FIG. 5 foundation garment assembly taken along the lines 6A —6A of FIG. 4, including prosthesis pocket.

FIG. 6B is a partial view, enlarged, in side elevation of the garment depicted in FIGS. 4, 5 and 6A aforesaid.

FIG. 7 is a rear perspective view relating to both species of invention.

FIG. 8 is a rear perspective view, enlarged, of the garment assembly of FIGS. 1, 2 and 3 inclusive.

DESCRIPTION OF THE PREFERRED EMBODIMENTS

The specific natural support foundation garment is adaptable not only to the average person, but also to the woman having the very full cup or to the full figured woman. It is particularly useful for sporting activities. The concept may likewise be adapted to various types of sporting garments, such as body suits and/or swimwear. Among the considerations which are pertinent to the development of the invention is that the female breast does not project directly from the chest cavity, but hangs just touching the chest cavity anywhere from ½ to 1½ inches or more depending on breast size. As will be noted hereinafter, the inventive concept forms a pocket wherein the breast may lie naturally without any changing of its shape, simultaneously giving the necessary support. Because of its characteristics, there is little vertical stretch to the bra, excepting as in the FIG. 4 modification adpated to the largest size woman, wherein there is provided an "undercup", hereinafter described. Activity bounce is minimized and to the wearer no "bottoming out" is sensed.

The so-called single cup configuration is best shown in FIGS. 1, 2, 3, 7, and 8, inclusive. This form of garment is especially for the persons utilizing a C or D cup size Brassiere. It will be noted that the lowermost portion of the garment comprises an expandable, wider than normal band 10 which is divided in the rear by appropriate fastening means. Stretch characteristics and orientation are indicated by arrows. In the rearmost portion of the garment, the band supports a chest-encircling support 12 which terminates at its rear end in vertical alignment with the opposed terminal elements of band 10. "The forward terminus of chest encircling support 12 is connected at a side juncture seam to the projecting outer front panel 20, which in turn is connected at its forward most arcuate edge to the primary support or cup 40. As indicated in FIG. 3, this outer front panel 20 is also connected along the juncture side seam to a projecting inner front panel 30. The inner front panel 30 includes along its free upper arcuate edge a pair of enclosures which serves to contain and anchor the supporting underwires 50. The first pair of primary supporting cups 40 are each connected to the outer front panel 20 along the arcuate seam connection." The specific pocket formed by the inter-relationship between each outer front panel 20, each inner front panel 30, each breast supporting cup 40 and underwire 50 causes contiguous positioning of the encased wire 50 upon the rib cage of the wearer. More specifically, and referring also to FIG. 3, the inter-position of outer front panel 20 between the supporting cup 40 and inner front panel 30 provides such a pocket for reception of the lower portion of the breast, with the underwires 50 being maintained in their arcuate enclosures along the top of the inner front panel 30. The underwire is thereby maintained on the chest wall of the wearer and does not lie up onto or press against the outside of the wearer's breast tissue. The inner front panel 30, bearing the underwire 50, along its upper edge is secured to the outer front 20 only at the center front neckline, the underarm and the band 10, thus permitting the underwire to rest on the chest and under the breast rather than on the breast. As the primary support cups are under strain, viz., in the course of stretching, exercising and the like, this interrelationship becomes significant. Notably, the attachment of the underwire 50 being set within the top of the inner front fabric 30, insures that the beginning of the pocket for the breast begins with the fabric extension provided by the inner front panel 30. Thus movement of the breast does not translate into movement of the underwires 50, both inner and outer front panels 20–30, combined with cups 40, working independently while supporting the breast. The substance of band 10, more specifically its attachment to outer front panel 20, reference FIG. 3, makes this stability possible. Note that elastic band 10 is elongated vertically and reinforced by folding upon itself. The entire bra is thus not displaced as in the prior art. Accordingly, in both the above and below invention, more fabric than usual is provided below the apex of the breast, wherein the preponderance of the weight depends.

Referring to FIGS. 4, 6A and 6B, inclusive, there is shown a cup assembly wherein like elements are represented by similar numerals, reference preceding single cup combination. This modification is specifically designed to accommodate full figured women, or women having larger than average busts. The addition 40" at the undercup provides additional volume, and is referred to as a double cup. It is necessary to accommodate larger breast sizes, starting with DD. Again, the reinforced band 10' forms an expandable base for the outer front panel 20' which has sideseam connection with the inner front panel 30', upon which support wire 50' is contained within an arcuate enclosure along its free upper edge. See FIG. 5, junction of panels 12', 20' and 30'. In this FIG. 4 concept, the outer front 20' has upper connection with the bottom of a secondary undercup 40" which is attached by seam to the base of the primary upper cup 40', hence "double cup". In this assembly, the lower or undercup 40" is composed of a vertically expandable supporting elastic fabric, whereas the other pattern elements are essentially of horizontal stretch characteristic. The effect herein is to cause the bra to conform naturally to the shape of the respective larger breasts, without reshaping or re-distributing breast mass, while also insuring the necessary support, with comfort. In this double cup bra of FIGS. 4, 6A and 6B the provision of the underwire 50', inner and outer front panels 30' and 20' contribute measurably to achieving the desired function of the invention. For example, the attachment of the underwire 50' being at the top of the stretchable fabric of the inner front panel 30' is such as to provide a beginning of the pocket for the respective breast, as formed by elements 20', 30', 40' and 40". As in the FIGS. 1–3 concept, the inner front panel with the underwire is attached to element 20' only at the center front neckline, underarm and band, any movement of the breast does not affect the underwire. In the specific double cup invention, FIGS. 4, 6A and 6B the inner and outer front panels work independently of one another and will continue to present breast support while the underwires 50' remain on the chest wall. This is in contrast to the prior art displacement of the entire bra as the breast may move or may be caused to move by arm reaching, stretching, etc. with the underwire moving over the front of the breast. Actually, the inner and outer front panels are detached to the extent that as the wearer exercises and the breast tissue moves up and down, the underwire is immobile, while panels 30' and 20' support the breast, no irritation from underwire 50 may occur.

Cup configuration in both the single and double cup bras defines shaped pockets for individual breasts. Each cup is specifically adapted to conform to the natural shape of the breast. In contrast to the prior art, substantially more room is provided due to stretchable fabric content below the breast apex, where the majority of the breast weight depends. In the instance of FIG. 4 bra, the supplemental cups 40' are composed of the same elastic fabric as the remainder of the bra, but the fabric has been rotated 90°, yielding a vertical stretch characteristic which results in presenting more depth to the basic supporting cups 40'. Clearly, the fabric and its stretch characteristics will contribute considerably to the mode in which the breast can shape the cup rather than, as customary, the cup being non expandably preconstructed to a specific shape into which the breast must fit.

With respect to the double cup bra of FIGS. 4, 5 and 6, the provision of underwire 50 and outer front panels 30' and 20' contribute measurably to achieving the desired function of the invention.

A preferred fabric is 140% denier LYCRA (T.M.) and 40% denier ANTRON (T.M.) nylon at 8 oz. per square yard, the same having 196% length and 30% width. The basic pattern is laid so that longitudinal stretch encircles the wearer's body, excepting in the 90° vertical stretch orientation of the undercup, reference FIGS. 4, 6A, and 6B With respect to the FIGS. 1, 2, 3 and 7 inclusive species: the respective first support cups, the inner and outer panels as well as the band are each composed of and oriented such that the elastic thereof yields a dominant horizontal stretch characteristic. In the species of FIGS. 4, 6A and 6B, inclusive, the respective second support cups, undercups 40" are composed of and oriented such that the elastic thereof yields a dominant vertical characteristic while in the first support cups 40', the panels and band have as well the same dominant characteristics as resides in the FIGS. 1–3 species. As indicated, a prosthesis pocket is adapted to both the species of FIGS. 1–3 inclusive, and FIGS. 4–6A and 6B. Such a pocket 60' is illustrated in FIG. 5–6A, B. A separate piece of fabric 60' is sewn at the top of the basic supporting cup 40', the fabric depending downward as in FIG. 6B, thereby forming a pocket from above. The prosthesis, not shown, may be inserted from the open front of the foundation, whereby it is held in place at bottom by the junction of elements 20'-30' as well as the pocket formed by undercup 40'' and supporting cup 40'. Although not illustrated, a similar arrangement for the species of FIGS. 1-3 prevails and is within the scope of the invention.

What is claimed is:

1. A underwire brassiere including in coactive relationship, a pair of breast cups, a lowermost stretchable elastic band, a chest encircling support, a pair of elastic outer front panels, an elastic inner front panel and arcuate underwire supports:

said lowermost stretchable elastic band encircling the lower terminus of the brassiere;

said chest encircling support having side and rear end sand including means for connecting the rear ends of the brassiere about the wear's body;

each of said elastic outer front panels having vertical outer side, arcuate top and horizontal bottom edges, said top edges secured to the respective outer edges of an adjacent breast cup, said bottom edges secured to the top edge of said lowermost elastic band and said outer edges secured to the side edges said chest encircling support at a juncture seam;

said inner front panel having vertical outer, arcuate top and horizontal bottom edges, said outer side edges secured to the outer side edges of said outer front panels and the side edges of said chest encircling support at said juncture seam, said bottom edges secured to the top edge of said lowermost elastic band, said top edge providing a pair of arcuate enclosures to contain said underwire supports; said arcuate top edge of the inner front panel and underwire supports contained therein freely extending inwardly of said breast cups toward the wear's chest cavity, with the elastic inner and outer front panels providing a pocket between said underwire and said cups for containing the lower periphery of the wear's breast forward of said underwires, and said pair of breast cups each having a lower edge, said lower edge being connected to the top edge of said elastic outer front panel and extending freely of the arcuate top edge of the inner front panel containing said underwire supports.

2. A brassiere according to claim 1, including means dependently connecting the pair of breast cups and the outer front panel to the lowermost band.

3. The brassiere of claim 1, wherein the breast cups, the inner and outer front panels and the lowermost band are composed of elastic members which each have a dominant horizontal stretch characteristic.

4. The brassiere of claim 3 wherein each of said breast cups includes a primary and a secondary breast support each panel connected to a lower edge of secondary panel is said primary panel of said breast cups; said secondary panels connecting the breast cups with the adjacent outer front panels, said secondary panels each having a dominant vertical stretch characteristic.

5. The brassier of either claims 2, 3, or 4 wherein at least one of the breast cups further includes an additional fabric over at least a portion of the breast cup surface to define a depending prosthesis pocket retainer.

* * * * *